US005761577A

United States Patent [19]

Walsh et al.

[11] Patent Number: 5,761,577

[45] Date of Patent: Jun. 2, 1998

[54] METHOD AND APPARATUS FOR REMOVING TONER WASTE FROM A TONER SUMP

[75] Inventors: Frank R. Walsh; Terry Catherman, both of Webster; Scott C. Durland, Fairport; Stephen C. Urciuoli, Honeoye Falls, all of N.Y.

[73] Assignee: Xerox Corporation, Stamford, Conn.

[21] Appl. No.: 798,753

[22] Filed: Feb. 13, 1997

[51] Int. Cl.[6] ..... G03G 15/00

[52] U.S. Cl. ..... 399/99; 399/107; 399/123; 399/358

[58] Field of Search ..... 399/1, 107, 99, 399/109, 110, 120, 123, 358, 360, 411

[56] References Cited

U.S. PATENT DOCUMENTS

| | | | |
|---|---|---|---|
| 4,601,569 | 7/1986 | Garris | 399/358 |
| 4,932,355 | 6/1990 | Neufeld | 399/257 |
| 5,243,388 | 9/1993 | Berns et al. | 399/90 |
| 5,349,425 | 9/1994 | Kamijo et al. | 399/120 |
| 5,349,427 | 9/1994 | Benedict et al. | 399/360 |

FOREIGN PATENT DOCUMENTS 5-165326 7/1993 Japan .

*Primary Examiner*—William J. Royer

[57] ABSTRACT

The present invention is a method and apparatus for vacuuming toner waste from a toner sump in a xerographic printing machine. A xerographic module in the machine contains a photoconductor, charging devices, a cleaning unit and the toner sump. When the toner sump approaches a full condition, the toner waste must be removed in order to prevent failure of the xerographic module seals. This is accomplished by removing the xerographic module from the machine, opening a sealed toner sump port and attaching a vacuum source to the toner sump port so that the toner waste can be removed with the vacuum source. A disposal adaptor tool sealingly engages the vacuum source to the toner sump at the toner sump port, allowing the toner to removed in a clean glove environment. Once the toner waste is removed from the toner sump, a new toner seal is placed over the toner sump port and the xerographic module is returned to the machine for further use.

18 Claims, 5 Drawing Sheets

METHOD AND APPARATUS FOR REMOVING TONER WASTE FROM A TONER SUMP

This invention relates generally to a method and apparatus for removing toner waste from an electrophotographic machine and is more particularly drawn to a method and apparatus for removing toner waste from a toner sump with a vacuum source which is attached to the toner sump by a disposal adaptor tool.

In conventional xerographic printing systems, waste toner generated in the cleaning operation is collected in toner waste bottles. When the toner waste bottle becomes full, it is removed and an empty bottle is inserted in its place. It is known to use a vacuum source to remove waste toner from a cleaning station which allows the waste toner to be stored in a location that is remote from the cleaning station. However, a new development in xerographic printing machines, a xerographic module, has created a new problem regarding the removal of toner waste. A xerographic module is a removable sealed unit housing with a photoconductor, charging stations, a cleaning station and a toner sump. The toner sump of the xerographic module is limited in size due to its attached position to the photoconductor and cleaning station. Because of the size limitations of the toner sump, the toner sump reaches its capacity for toner waste prior to the extinction of the useful life of the xerographic module. In order to continue using the xerographic module, the toner waste sump must be emptied or catastrophic failure will result. It is highly desirable to have the toner waste removed from the toner sump in a clean glove manner so that the cleaning operation can occur at the site of the xerographic machine.

The following disclosures may be relevant to various aspects of the present invention:

U.S. Pat. No. 4,932,355,

Inventor: Neufeld,

Issued: Jun. 12, 1990.

U.S. Pat. No. 4,601,569,

Inventor: Garris,

Issued: Jul. 22, 1986.

U.S. Pat. No. 5,243,388,

Inventor: Berns et al.,

Issued: Sep. 7, 1993.

U.S. Pat. No. 5,349,427,

Inventor: Benedict et al.,

Issued: Sep. 20, 1994.

Some relevant portions of the foregoing disclosures may be briefly summarized as follows:

U.S. Pat. No. 4,932,355 teaches a method and apparatus for removing developer mix from a developing station. The developing station, at its lower portion, includes a channel-like discharge opening which extends over the full width of the developing station. A magnetic closing device is provided in the vicinity of the discharge opening and functions so that in its energized condition, its magnetic field acts on the developer mix to form a plug of developer mix in the region of the discharge opening which closes off the discharge opening. In the de-energized condition, the magnetic closing device releases the discharge opening whereupon the developing station can be emptied by the action of a suction device such as a blower.

U.S. Pat. No. 4,601,569 discloses a cleaning apparatus with a cleaning brush for removing residual toner from a photoconductor. A hollow rotating detoning roller electrostatically removes toner from the cleaning brush. The detoning roller has apertures in the surface thereof allowing toner to be mechanically swept by a blade into the hollow portion of the detoning roller. A stationary auger transports the toner to one end of the roller where it may be vacuumed up.

U.S. Pat. No. 5,243,388 shows another method and apparatus for cleaning developer mix from a developer unit. The developer unit is mounted in a retractable drawer within the electrophotographic printing machine. A cover is placed over the developer unit which is provided with an air inlet and an air outlet. A vacuum machine is connected to the air outlet to create a wind flow within the developer unit for cleaning the unit. A tool is provided for turning the auger within the developer unit when it is being cleaned.

U.S. Pat. No. 5,349,427 discloses a sealed system for collecting and removing waste imaging material from a reproduction apparatus in a waste collection container removably insertable into the reproduction apparatus so that the inlet opening of the container is positioned at the discharge outlet of a pneumatic cleaning system. The container has a dual mode resilient pneumatic seal surrounding its inlet, and an integral insertion guide member. The cleaning system discharge outlet includes a spring loaded sled member and a flexible pneumatic seal connecting between the sled member and the discharge outlet to allow limited movement of the sled member. The insertion guide member of the container slides on an entrance guide path into compressed superposed engagement with the sled member to form a sealed waste material path between the discharge outlet of the reproduction apparatus cleaning system and the interior of the waste container when so inserted.

All of the above references are hereby incorporated by reference.

SUMMARY OF THE INVENTION

One aspect of the present invention is drawn to a method for removing toner waste from a xerographic printing machine. First, a seal is removed from an exit port on a toner sump housing where toner waste is collected. A disposal adaptor tool is attached to the exit port and the the toner waste is moved from the toner sump housing via the disposal adaptor tool into a toner waste container. The disposal adaptor tool is then detached and a seal is placed over the exit port in order to reseal the toner sump housing.

Another aspect of the invention is drawn to a method for removing toner waste from a xerographic module of a xerographic printing machine. The xerographic module contains a cleaning station and a toner sump for storing toner waste and is sealed so that toner waste is contained in the xerographic module. A seal is removed from an exit port on the xerographic module adjacent the toner sump and a disposal adaptor tool is attached to the exit port. The toner waste is vacuumed from the toner sump via the disposal adaptor tool into a toner waste container. After the vacuuming operation, the disposal adaptor tool is detached and a seal is placed over the exit port in order to reseal the xerographic module.

Yet another aspect of the invention is drawn to an apparatus for removing toner waste from a xerographic module in which a toner sump housing contains toner waste. The toner sump housing has a normally sealed exit port to which a disposal adaptor tool is selectively attached. A vacuum source is attached by the disposal adaptor tool to the toner sump, whereby the disposal adaptor tool sealingly attaches the toner sump to a toner waste container so that the toner waste remains contained while the toner waste is moved from the toner sump to the toner waste container by the vacuum source in a clean glove environment.

The present invention is a method and apparatus for vacuuming toner waste from a toner sump in a copying machine. A xerographic module in the copying machine contains a photoconductor, charging devices, a cleaning unit and the toner sump. When the toner sump approaches a full condition, the toner waste must be removed in order to prevent failure of the xerographic module seals. This is accomplished by removing the xerographic module from the copying machine, opening a sealed toner sump port and attaching a vacuum source to the toner sump port so that the toner waste can be removed with the vacuum source. A disposal adaptor tool sealingly engages the vacuum source to the toner sump at the toner sump port, allowing the toner to removed in a clean glove environment. Once the waste toner is removed from the toner sump, a new toner seal is placed over the toner sump port and the xerographic module is returned to the copying machine for further use.

BRIEF DESCRIPTION OF THE DRAWINGS

Other features of the present invention will become apparent as the following description proceeds and upon reference to the drawings, in which.

DETAILED DESCRIPTION OF THE INVENTION

Figure 1:
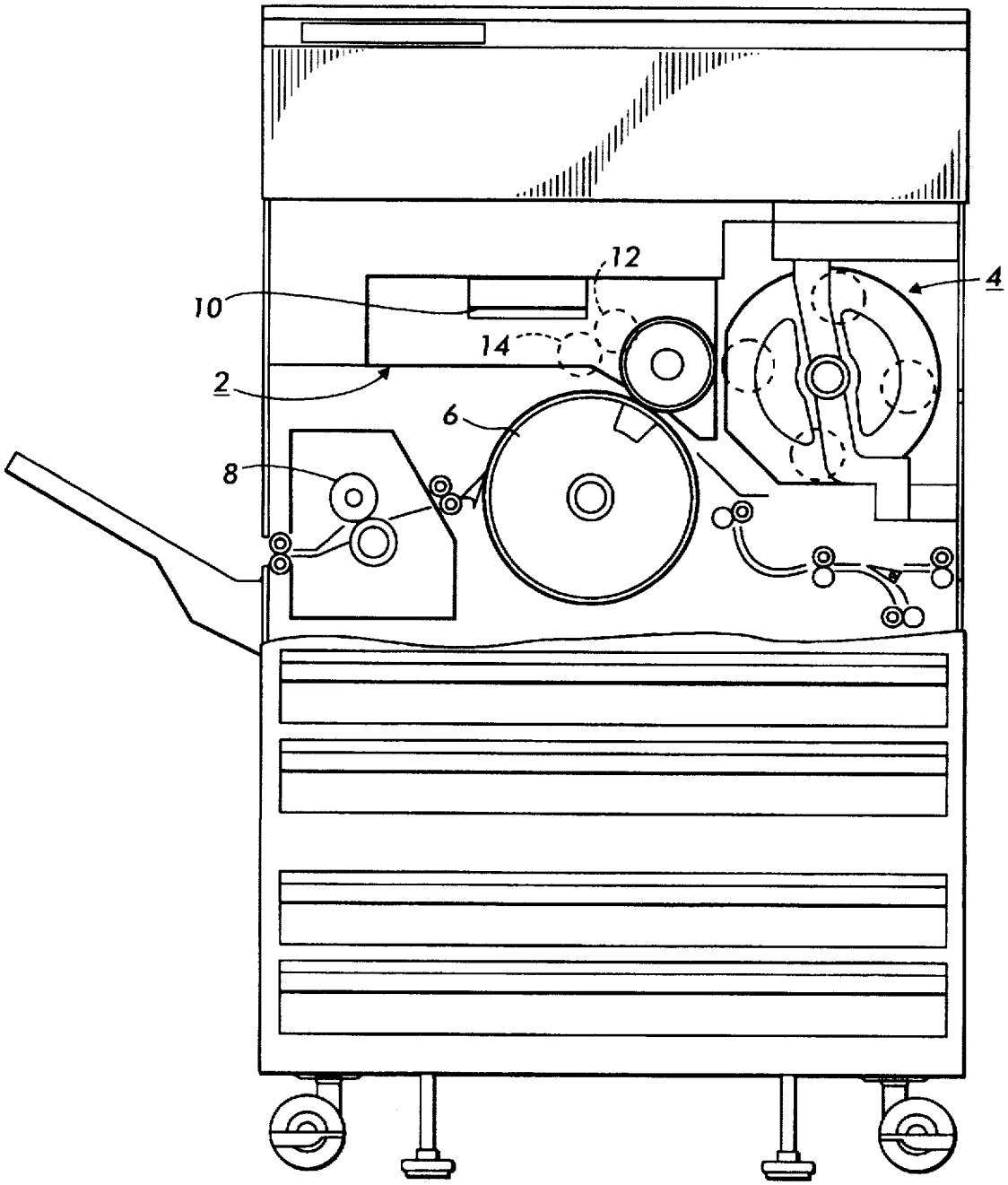
FIG. 1 is a view of the interior of a xerographic printing machine.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements. It will be evident from the following discussion that the present invention is equally well suited for use in a wide variety of printing systems, and is not necessarily limited in its application to the particular system shown.

FIG. 1 shows the interior of a xerographic printing machine with a xerographic module 2, a developer unit 4, a transfer unit 6 and a fusing unit 8. Xerographic module 2 has handle 10, cleaner brush external gear 12 and toner moving member external gear 14, the external gears are attached to their respective elements as described below.

Figure 2:
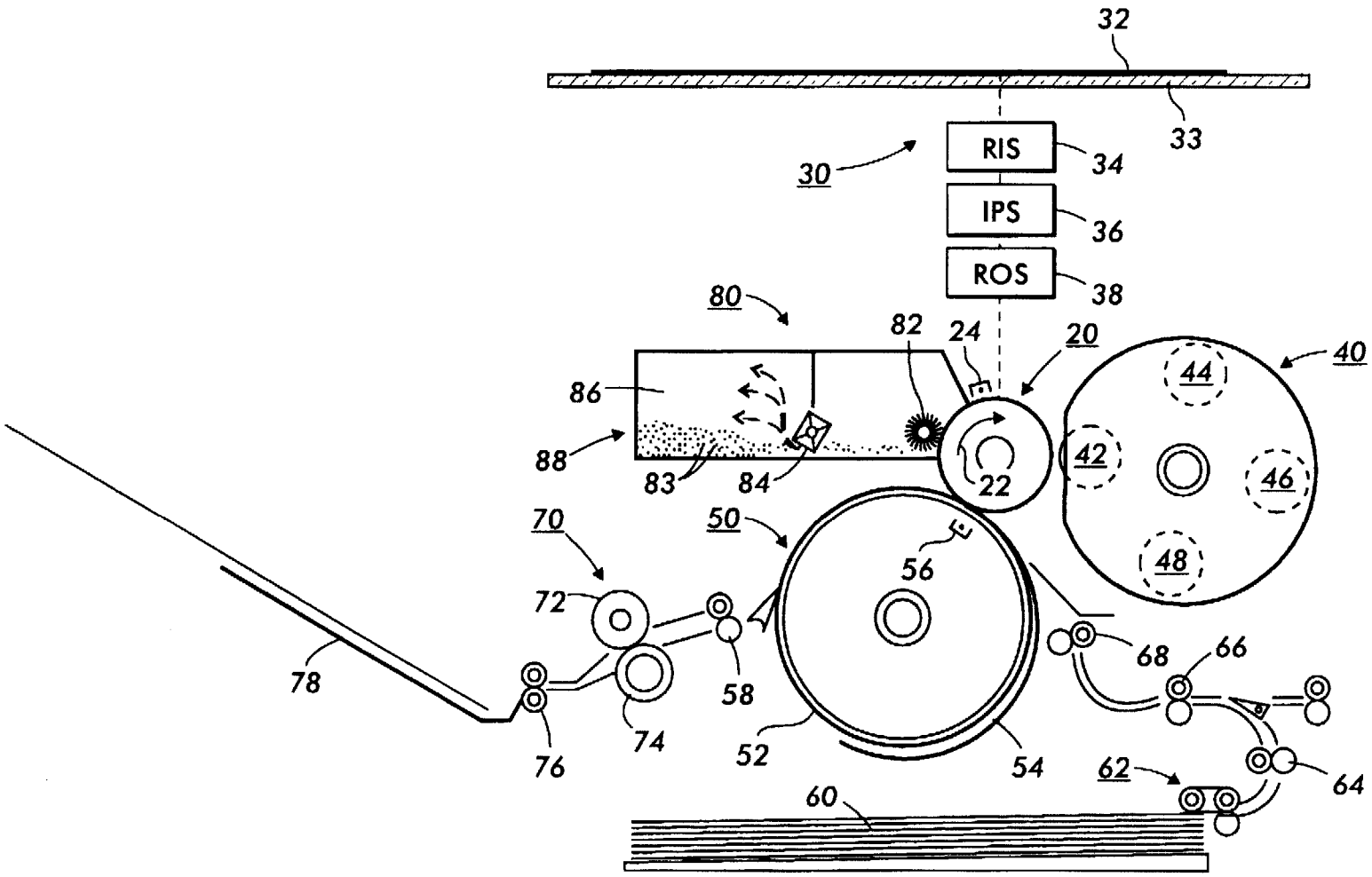
FIG. 2 is a schematic operational view of the xerographic printing machine.

Referring now to FIG. 2, there is shown a schematic view of an electrostatographic or xerographic printing or copying machine employing a photoconductor 20. Photoconductor 20 moves in the direction of arrow 22 to advance successive portions of the surface sequentially through the various processing stations disposed about the path of movement thereof.

Initially, a portion of photoconductor 20 passes through the charging station. At the charging station corona generating device 24 charges photoconductor 20 to a relatively high, substantially uniform potential.

Next, the charged photoconductor is rotated to the imaging station 30. At the imaging station, original document 32 is positioned on a transparent platen 33. Imaging station 30 also includes a raster scanning system which includes a raster input scanner (RIS) 34, an image processing system (IPS) 36 and a raster output scanner (ROS) 38. The RIS scans the original document one line at a time generating signals with each signal being representative of at least one color component in original document 32. The RIS captures the entire image from the original document 32 and converts it to a series of raster scan lines which are transmitted as electrical signals to IPS 36. The electrical signal from the RIS correspond to red, green and blue intensities at each point in the document. The IPS takes the red, green and blue signals and connects them to the proper cyan, magenta and yellow signals transmitted to ROS 38. The ROS illuminates the charged portion of the photoconductive surface to record four electrostatic latent images on the photoconductor.

After the electrostatic latent image has been recorded on photoconductor 20, the photoconductor advances the electrostatic image to the development station 40. The development station includes four individual developer units generally indicated by the reference numerals 42, 44, 46 and 48. The developer units may be any kind of development unit. Developer units 42, 44, 46 and 48 respectively apply toner particles of magenta, yellow, cyan and black color. Each of the developer units is moved into and out of the operative position. In the operative position, the desired developer unit is moved adjacent to the photoconductor. In FIG. 2, developer unit 42 is shown in the operative position with developer units 44, 46 and 48 being in the non-operative position.

After development, the toner image is moved to the transfer station 50 where the toner image is transferred to a sheet of support material 54. At the transfer station, the transfer roll 52, moves a sheet into contact with photoconductor 20. Transfer roll 52 electrostatically tacks the sheet of support material to its surface where the sheet may be retained for multiple transfers.

The sheet is advanced from a stack of sheets 60 disposed on a tray. A feeder roll mechanism 62 advances the sheet to vertical sheet transport rollers 64. The sheet continues along the paper path to preregistration rollers 66 and registration rollers 68. These roller assemblies continue driving the sheet from the vertical transport, de-skew the sheet and release the sheet to the transport roll for image transfer.

At the transfer zone, a corona generating device 56 puts a charge on the inside surface of the transfer, roll so that the toner particles are attracted to the support material on the transfer roll. The sheet remains secured to the transfer roll 52 so as to move in a recirculating path for as many passes as colors developed. In this way, the cyan, yellow, magenta and black toner images are transferred to the sheet in superimposed registration with one another to form a multi-color copy of the colored original document.

After the last transfer operation, the sheet is released from transfer roll 52. Transport rollers 58 transport the sheet to the fusing station 70 where the transferred image is permanently fused to the sheet. The fusing station includes a heated fuser roll 72 and a pressure roll 74. The sheet passes through the nip defined by fuser roll 72 and pressure roll 74. The toner image contacts fuser roll 72 so as to be affixed to the sheet. Thereafter, the sheet is advanced by forwarding rollers 76 to catch tray 78.

The last processing station in the direction of movement of photoconductor 20, as indicated by arrow 22, is the cleaning station 80. The cleaning process takes place after each color is developed. A rotatably mounted fibrous cleaning brush 82 is positioned in the cleaning station and maintained in contact with photoconductor 20 to remove residual toner particles 83 remaining after the transfer operation. Toner moving member 84 rotates to move toner collected by the fibrous brush into toner waste sump 86. The exit port 88 is located at the end board backside of the xerographic module.

Figure 3:
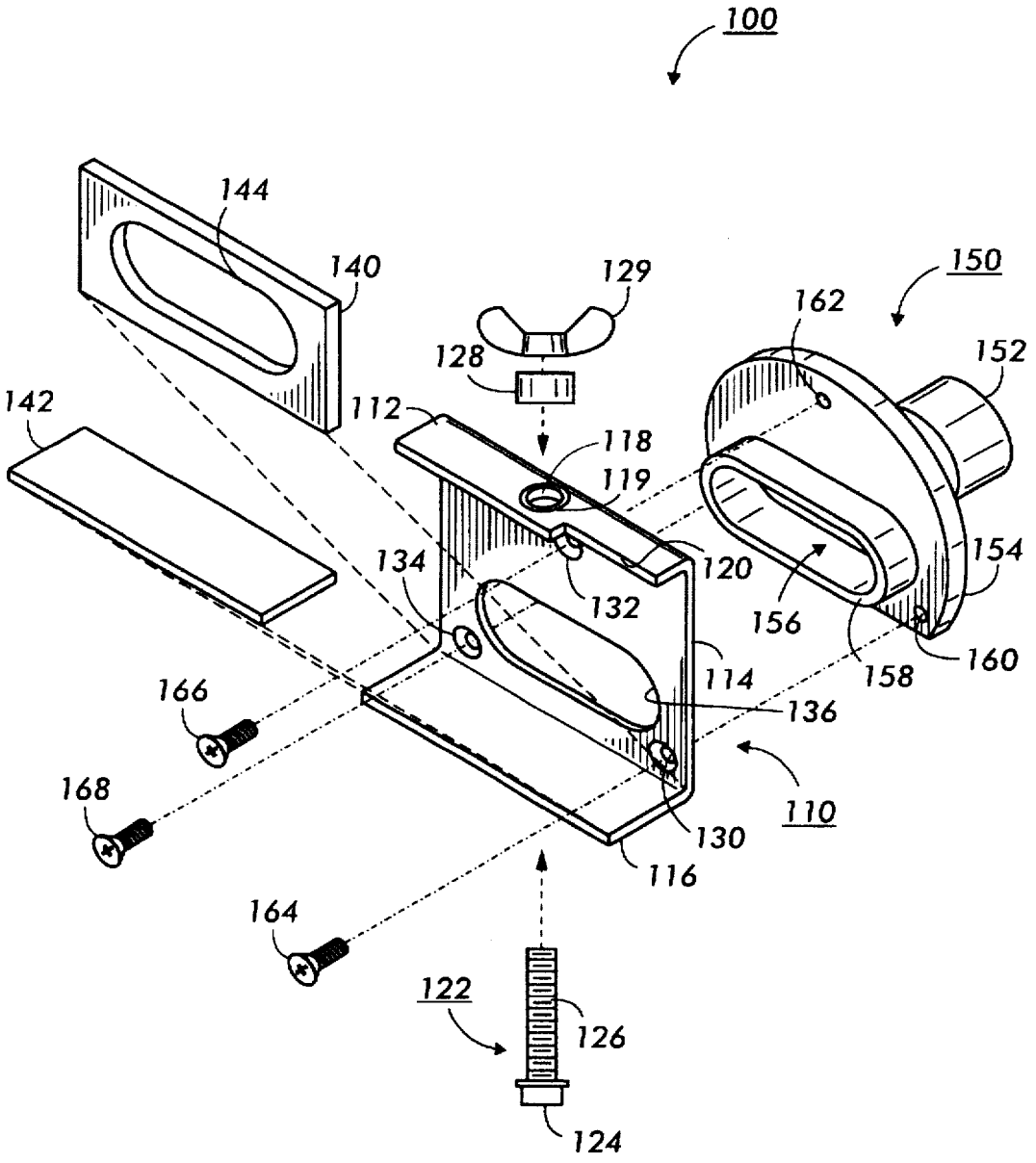
FIG. 3 is an exploded view of the disposal adaptor tool.

FIG. 3 is a detailed exploded view of disposal adaptor tool 100. The disposal adaptor tool is made up of two major components, an L bracket 110 and a vacuum nozzle assembly 150. The L-bracket has a top member 112, side member 114 and bottom member 116 as shown. Top member 112 has top member opening 118 and a locating notch 120. Opening 118 has a threaded insert 119 which allows screw 122 with a padded end 124 and a free end 126 to be inserted therein. Lock nut 128 and wing nut 129 are fastened to the free end 126 of the screw 122 once the screw is positioned in opening 118. Side member 114 has three side member screw openings 130, 132 and 134 and an elongated L-bracket opening 136. A side seal pad 140 and a bottom seal pad 142 fit against side member 114 and bottom member 116. Side seal pad 140 has an elongated side seal opening 144 which is aligned with L-bracket opening 136 when the pad members are glued to the L-bracket. Pad seals 140 and 142 may be made of any resilient material such as rubber so that a tight toner seal is formed between the xerographic module housing and the pads when the L-bracket is clamped in place.

Vacuum nozzle assembly 150 has a hose nozzle 152 and a nozzle mat 154. Hose nozzle 152 and nozzle mat 154 sealingly engage one another or are integrally formed so that they form a sealed assembly. Nozzle mat 154 has an elongated nozzle mat opening 156 and a nozzle mat extension 158 which surrounds the nozzle mat opening. The nozzle mat has three nozzle mat screw openings, however only two nozzle mat screw openings 160 and 162 are shown. Three nozzle mat screws 164, 166 and 168 attach the nozzle mat to L-bracket 110 when inserted in openings 130, 132 and 134. The hose nozzle, nozzle mat and nozzle mat extension can be made of a resilient material such as plastic, rubber or UHMW industry standard-black plastic so that when the nozzle assembly is attached to L-bracket 110 a seal is formed between the nozzle assembly and the L-bracket. Nozzle mat extension 158 and L-bracket opening 136 are sized so that they form a seal when assembled together.

Figure 4:
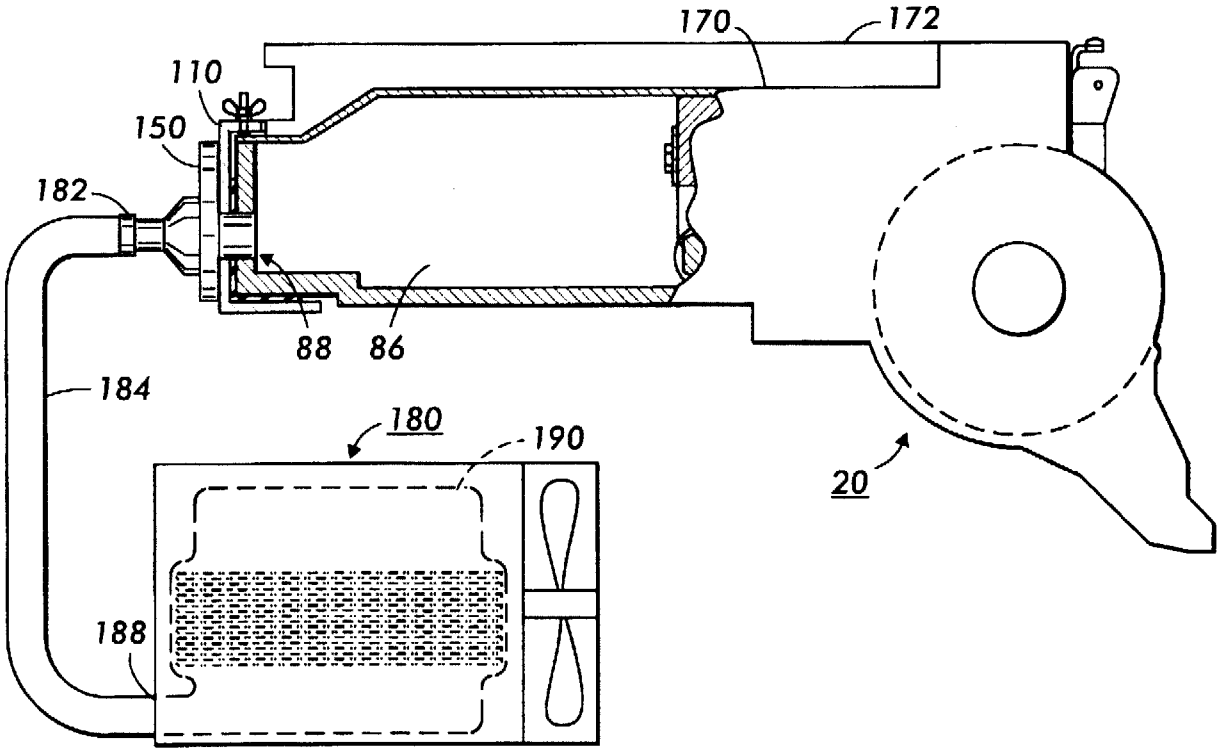
FIG. 4 is a cross-sectional view of the xerographic module with the disposal adaptor tool attached thereto.

FIG. 4 depicts the xerographic module removed from the copying machine with the disposal adaptor tool 100 attached to the toner exit port 88 of the toner waste sump 86. Prior to clamping the disposal adaptor tool to the xerographic module housing, the customer service engineer (CSE) positions the disposal adaptor tool against the housing, using locating notch 120 as an alignment mechanism so that nozzle mat extension 158 fits into toner exit port. Locating notch 120 fits between the first cover 170 and the second cover 172 (see FIG. 5).

Once the disposal adaptor tool is properly positioned, the CSE will rotate wing-nut 129 causing screw pad 124 to press against the xerographic module housing. Screw pad 124 and bottom pad 142 have sufficient thickness and resiliency to allow maximum compression when extreme vertical force is applied by rotation of the wing-nut. This design acts as an over-torque limiter and prevents the customer service engineer from exerting abnormal force to the xerographic module housing, which prevents damage to the housing during the clamping operation. When the L-bracket is clamped to the xerographic module housing, the side pad 140 forms a clamping pad at the bottom of the bracket and a toner housing seal around the front side of the nozzle.

The disposal adaptor tool will now allow the CSE to hold the xerographic module and operate external cleaning brush gear 12 and external toner moving member gear 14 to achieve maximum toner waste vacuuming without having to also hold the disposal adaptor tool in place. Hose nozzle 152 is attached to a vacuum source 180 by vacuum nozzle 182 and vacuum hose 184. Vacuum source 180 can be any vacuum cleaner which has sufficient vacuum strength to move pure toner. In order to contain the toner once it is in the vacuum cleaner. The waste toner enters the vacuum at vacuum opening 188 and is trapped by waste toner filter 190. Waste toner filter 190 must have a very fine structure in order to trap the toner particles. A toner filter with a pore size of 0.3 microns has been used to successfully retain the vacuumed toner. Once it is removed from the vacuum cleaner and the filter 190 is sealed. The sealed full toner filter can then be properly disposed of without contaminating the customer's site.

For the most effective toner sump cleaning, the xerographic module is held at approximately 45 degree angle to the CSE with the disposal adaptor tool at the lowermost end so that gravity will assist in the toner vacuuming operation. The CSE can then hold the xerographic module and operate external gears 12 and 14 for cleaning brush 82 and toner moving member 84 by turning the gears by hand so that toner is released from these components. This vacuuming procedure takes approximately 3–5 minutes and results in approximately 97% of the waste toner being removed from the toner sump. It is estimated that between 300 to 400 grams of waste toner will be removed.

Figure 5:
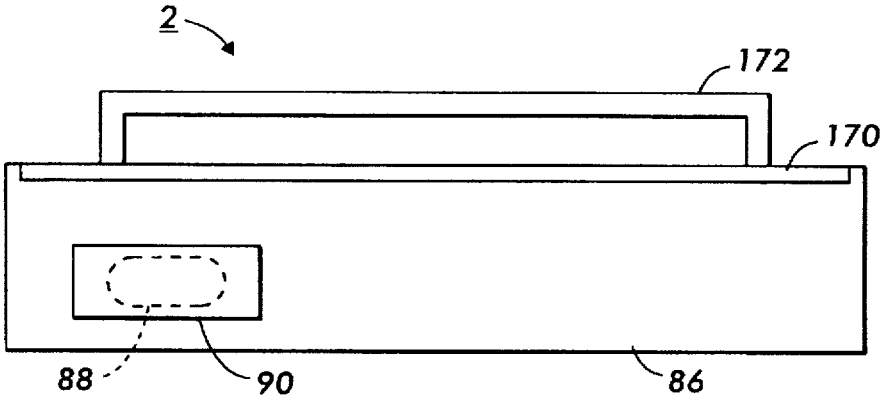
FIG. 5 is an end view of the xerographic module.

After the vacuuming operation, the exit port 88 is re-sealed with a toner sump seal 90 as shown in FIG. 5. The toner sump seal may be an adhesive backed toner seal, a plug or any other toner sealing member which effectively seals the exit port so that the toner waste will remain sealed in toner waste sump when the xerographic module is returned to the machine for further use.

It is, therefore, apparent that there has been provided in accordance with the present invention, a disposal adaptor tool used in vacuuming toner waste from a toner sump that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method for removing toner waste from a xerographic printing machine, comprising:

removing a seal from an exit port on a toner sump housing where toner waste is collected;

attaching a disposal adaptor tool to the exit port;

moving the toner waste from the toner sump housing via the disposal adaptor tool into a toner waste container;

detaching disposal adaptor tool from the exit port; and placing a seal over the exit port in order to reseal the toner sump housing.

2. The method as claimed in claim 1, wherein moving the toner waste includes:

vacuuming the toner waste from the toner sump housing into the toner waste container at the rate of between 80–100 grams/minute.

3. The method as claimed in claim 1, wherein attaching the disposal adaptor tool includes sealingly attaching the disposal adaptor tool to the toner waste container so that the toner waste remains contained as it moves from the toner sump housing to the toner waste container.

4. The method as claimed in claim 1, further comprises:

detaching the toner sump housing from the xerographic printing machine prior to removing the seal from the exit port; and attaching the toner sump housing to the xerographic printing machine after the toner sump housing is resealed.

5. The method as claimed in claim 1, wherein attaching the disposal adaptor tool to the exit port comprises:

clamping the disposal adaptor tool to the toner sump housing and providing an overtorque prevention mechanism to limit the clamping force on the toner sump housing.

6. The method as claimed in claim 1, further comprises:

detaching a xerographic module from the xerographic printing machine prior to removing the seal from the exit port, the xerographic module containing a cleaning station and the toner sump housing, the xerographic module being a sealed unit so that the toner waste remains contained therein.

7. The method as claimed in claim 6, wherein moving toner waste from the toner sump housing includes:

turning an external gear on the xerographic module which operates a toner moving member which moves toner waste from the cleaning station to the toner sump housing.

8. The method as claimed in claim 6, wherein moving toner waste from the toner sump housing includes:

turning an external gear on the xerographic module which operates a cleaning brush in the cleaning station which moves toner waste from the cleaning station.

9. The method as claimed in claim 6, includes:

orienting the xerographic module so that the exit port is at the lowest point of the xerographic module whereby gravity assists in moving the toner waste from the toner sump housing.

10. A method for removing toner waste from a xerographic printing machine, comprising:

removing a xerographic module containing a cleaning station and a toner sump storing toner waste from the xerographic printing machine, the xerographic module being sealed so that toner waste is contained in the xerographic module;

removing a seal from an exit port on the xerographic module adjacent the toner sump;

attaching a disposal adaptor tool to the exit port;

vacuuming the toner waste from the toner sump via the disposal adaptor tool into a toner waste container;

detaching the disposal adaptor tool; and placing a seal over the exit port in order to reseal the xerographic module.

11. An apparatus for removing toner waste from a xerographic module, comprising:

a toner sump housing for containing toner waste in the xerographic module;

a toner sump housing exit port;

a disposal adaptor tool which is selectively attached to the exit port; and a vacuum source attached by the disposal adaptor tool to the toner sump housing, whereby the disposal adaptor tool sealingly attaches the toner sump housing to a toner waste container so that the toner waste remains contained while the toner waste is moved from the toner sump housing to the toner waste container by the vacuum source in a clean glove environment.

12. The apparatus as claimed in claim 11, wherein the disposal adaptor tool includes:

a clamp;

a side seal pad and a bottom seal pad which fit between the clamp and the toner sump housing; and a vacuum nozzle assembly.

13. The apparatus as claimed in claim 12, wherein the clamp includes:

a L-bracket with top, side and bottom members which fit against the toner sump housing, the top member having an opening therethrough;

a L-bracket opening in the side L-bracket member;

a side seal pad opening in the side seal pad; and a screw member through the top member opening which fastens the clamp to the toner sump housing.

14. The apparatus as claimed in claim 13, wherein the screw member includes:

a padded end which fits against toner sump housing and an end with a wing nut and a lock nut, the padded end and bottom seal pad assist in acting as an overtorque prevention mechanism which prevents damage to the toner sump housing when the disposal adaptor tool is attached to the toner sump housing.

15. The apparatus as claimed in claim 13, further comprising:

a locating notch on the top member of the L-bracket for locating the disposal adaptor tool with respect to the toner sump housing.

16. The apparatus as claimed in claim 13, wherein the vacuum nozzle assembly includes:

a nozzle mat with a vacuum nozzle, a nozzle mat hole and a nozzle mat extension, the nozzle mat extension surrounding the nozzle mat hole and extending through the L-bracket opening into the toner sump housing when the disposal adaptor tool is attached to the exit port.

17. The apparatus as claimed in claim 12, the vacuum source further comprising:

a vacuum hose attached to the vacuum nozzle assembly and the vacuum source; and a toner waste container for receiving the toner waste in the vacuum source.

18. The apparatus as claimed in claim 17, wherein the toner waste container includes a paper filter with a less than 1 micron pore size.

* * * * *